US005340038A

United States Patent [19]

Omann

[11] Patent Number: 5,340,038

[45] Date of Patent: Aug. 23, 1994

[54] MATERIAL REDUCTION APPARATUS

[76] Inventor: Lawrence F. Omann, 39947 - 95th Ave., St. Joseph, Minn. 56374

[21] Appl. No.: 967,159

[22] Filed: Oct. 27, 1992

[51] Int. Cl.[5] ..... B02C 18/02; B02C 18/28

[52] U.S. Cl. ..... 241/84; 241/94; 241/205; 241/219; 241/273.3; 241/283

[58] Field of Search ..... 241/84, 94, 262, 273.3, 241/283, 205, 206, 201, 219

[56] References Cited

U.S. PATENT DOCUMENTS

| | | | |
|---|---|---|---|
| 12,696 | 4/1855 | Russell | 241/219 |
| 170,745 | 12/1875 | Kruse . | |
| 283,212 | 8/1883 | Cranson . | |
| 307,820 | 11/1884 | Tiffany . | |
| 1,113,229 | 10/1914 | Lyle . | |
| 1,238,117 | 8/1917 | Dupuy . | |
| 1,312,986 | 8/1919 | Hoffman . | |
| 2,124,934 | 7/1938 | Urschel | 241/283 |
| 2,518,237 | 8/1950 | Inskeep | 241/206 |
| 3,709,441 | 1/1973 | Hessner et al. | 241/94 |
| 3,823,881 | 7/1974 | Grob | 241/79.1 |
| 4,580,732 | 4/1986 | Mantell | 241/30 |
| 4,706,893 | 11/1987 | Brock | 241/23 |
| 4,848,679 | 7/1989 | Blumer | 241/84 |
| 5,082,187 | 1/1992 | Kirchoff et al. | 241/84 |
| 5,249,750 | 10/1993 | Gundlach et al. | 241/69 |

FOREIGN PATENT DOCUMENTS

| | | | |
|---|---|---|---|
| 1254880 | 12/1961 | France | 241/262 |
| 0602640 | 4/1978 | U.S.S.R. | 241/283 |

*Primary Examiner*—Mark Rosenbaum
*Assistant Examiner*—John M. Husar
*Attorney, Agent, or Firm*—Palmatier, Sjoquist & Helget

[57] ABSTRACT

A material reduction apparatus has a material loading bin for receiving material to be reduced. Below the bin is located a plurality of substantially parallel cutter bars with opposing ends and cutting tips thereon. The cutter bars are supported below the bin. Crank means are pivotally connected to at least one end of each cutter bar for alternatingly moving each cutter bar upward and downward as well as parallel in line left to right unlike the movement of the adjacent cutter bar for kicking, tossing and cutting the material to be reduced.

36 Claims, 6 Drawing Sheets

Fig. 4.
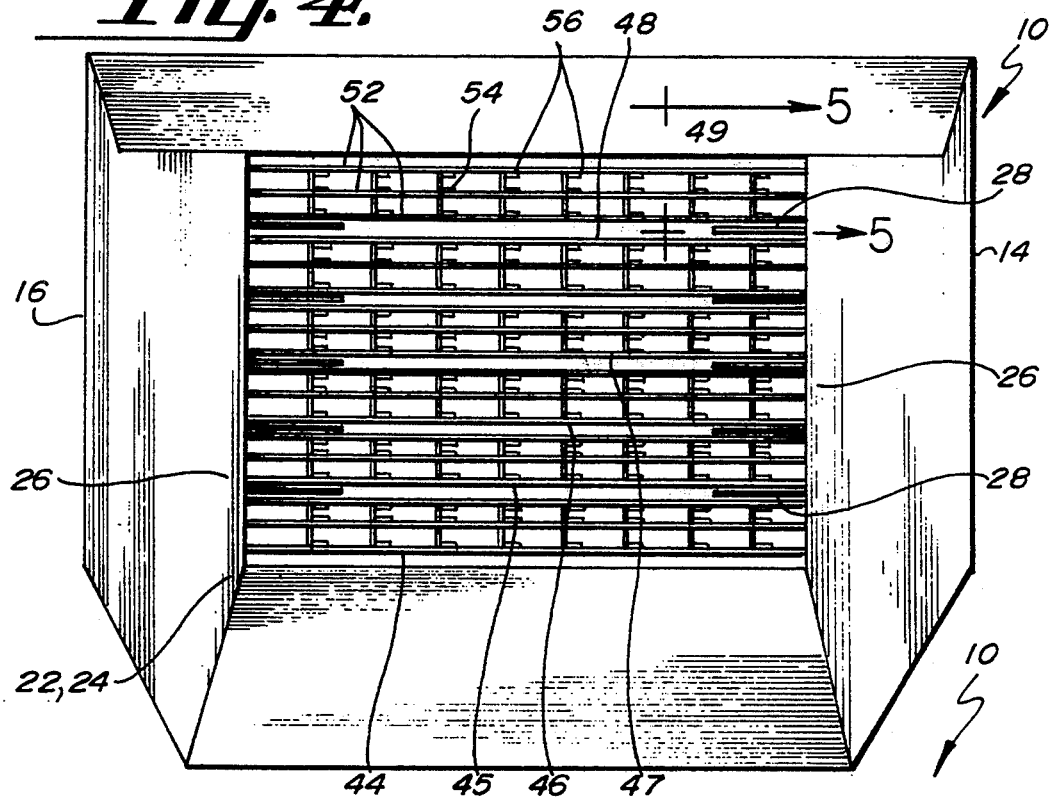
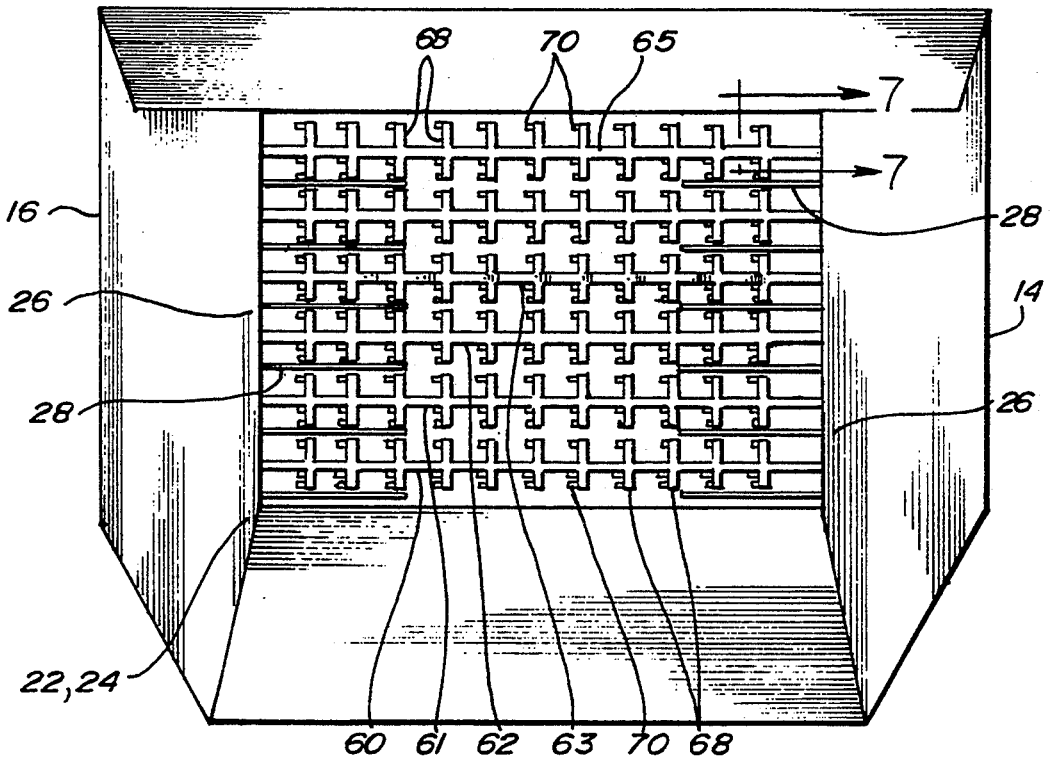
Fig. 6.

MATERIAL REDUCTION APPARATUS

BACKGROUND OF THE INVENTION

This invention relates to the recycling, further processing and conservational disposal of petroleum impregnated materials, wood materials and frangible materials. More particularly, the invention is a material reduction apparatus for such materials.

Petroleum impregnated materials generally include shingles, tar paper and the like. In manufacturing shingles and fitting the shingles to roofs of buildings, there is a substantial volume of waste. This is also the case with respect to tar paper. These materials are impregnated with petroleum or oil up to approximately thirty percent. What is often left are literally piles of shingle pieces and tar paper which become quite heavy. Consequently, the materials have a great tendency to clump or stick together, further making the handling of such waste materials quite difficult. However, if the materials can be greatly reduced in size, they may be further reduced to particles and utilized for new construction projects including roadways and shock absorbent athletic fields.

Wood materials, such as large and small stumps or irregular shapes, are difficult to deal with in that they are too bulky for simple burial and serve no other useful purpose. Consequently, the reduction of these wood materials is highly desirable for the creation of saw dust products, particle board or simple space efficient burial disposal.

Frangible materials, such as concrete, also pose a similar problem as do wood materials. They are difficult to dispose of due to their irregular shapes and requirement for large underground space requirements. Consequently, there is a great desire to reduce concrete materials to small sizes which will then permit the reduced frangible material to be used for road bedding, rip rap or simple space efficient disposal.

There are machines for reducing the size of some materials. U.S. Pat. No. 5,082,187 issued to Kirchhoff et al. discloses a vibrating screen crusher commonly used in crushing particular soft stones. U.S. Pat. No. 3,823,881 issued to Grob reveals a device for crushing large sand pieces utilizing transversely arranged blades which are oscillated at high speed for breaking up the sand chunks. U.S. Pat. No. 3,709,441 issued to Hessner et al. describes a machine for disintegration of cellulose pulp sheets which utilizes parallel tearing tooth rods of two interleaved groups that are moved in horizontal directions. U.S. Pat. No. 1,312,986 issued to Hoffman et al. shows parallel cutting rods vertically arranged for the manufacture of paper excelsior from larger pieces of paper pneumatically transported through the machine.

There is a need for a reduction apparatus for reducing in size a variety of materials including petroleum impregnated shingles and related tar paper that may be stuck together in substantial clumps, wood materials such as stumps, and frangible materials such as cement. The apparatus should readily tear and bounce about the materials in a kicking fashion as to aid in their reduction apart from simple tearing alone.

SUMMARY OF THE INVENTION

A material reduction apparatus has a material loading bin for receiving material to be reduced. Below the bin is located a plurality of substantially parallel cutter bars with opposing ends and cutting tips thereon. The cutter bars are supported below the bin. Crank means are pivotally connected to at least one end of each cutter bar for alternatingly moving each cutter bar upward and downward as well as parallel in line left to right unlike the movement of the adjacent cutter bar for kicking, tossing and cutting the material to be reduced.

A principal object and advantage of the present material reduction apparatus is its ability to reduce in size a variety of materials, such as petroleum impregnated materials, wood materials, and frangible materials, for recycling, further processing or conservational disposal.

Another object and advantage of the present invention is its ability to pull apart and cut petroleum base material which heretofore was difficult to deal with let alone considered for recycling.

Another object and advantage of the present invention is its ability to toss and kick about the material to be reduced permitting the apparatus to work on the material during its reduction from more than one side, which will permit relatively fast material reduction than heretofore known.

Another object and advantage of the present invention is that the apparatus readily fits within an automated process for loading that material into the apparatus and carrying the reduced material away for further recycling, processing or disposal without the need for manual attention.

BRIEF DESCRIPTION OF THE DRAWINGS

FIG. 4 is a top plan view of the apparatus showing another form of cutter bars;

FIG. 6 is a top plan view of the apparatus with yet another form of cutter bars;

DETAILED SPECIFICATION

Figure 1:
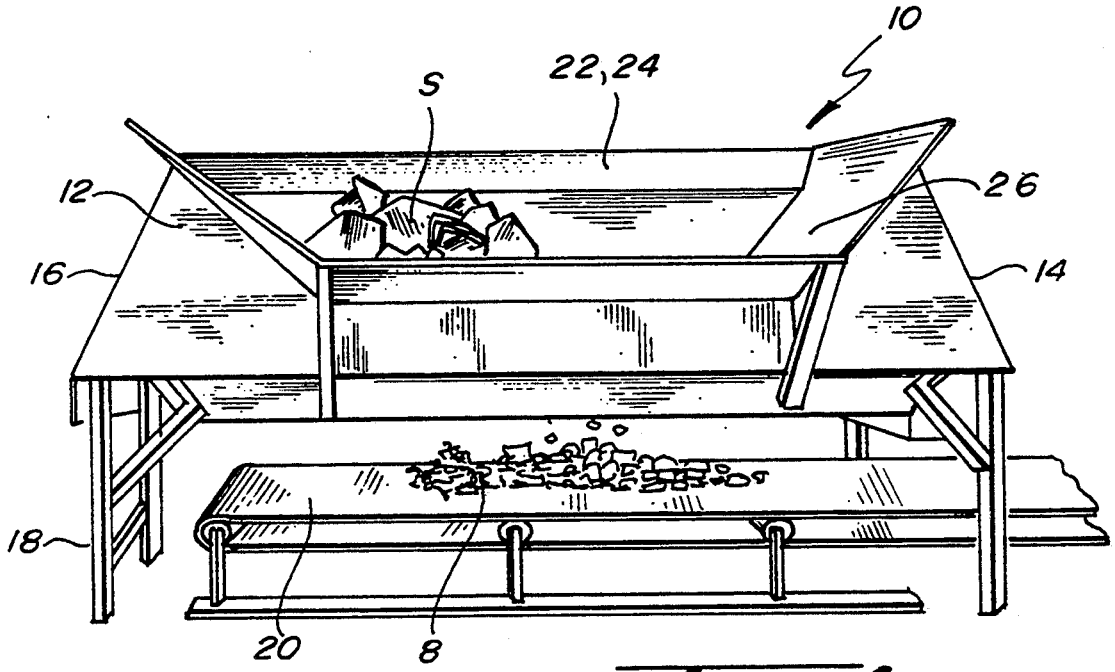
FIG. 1 is a front elevational view of the material reduction apparatus with material being worked on in the bin and reduced material falling out of the apparatus onto a conveyor therebelow for transport away from apparatus.
Figure 2:
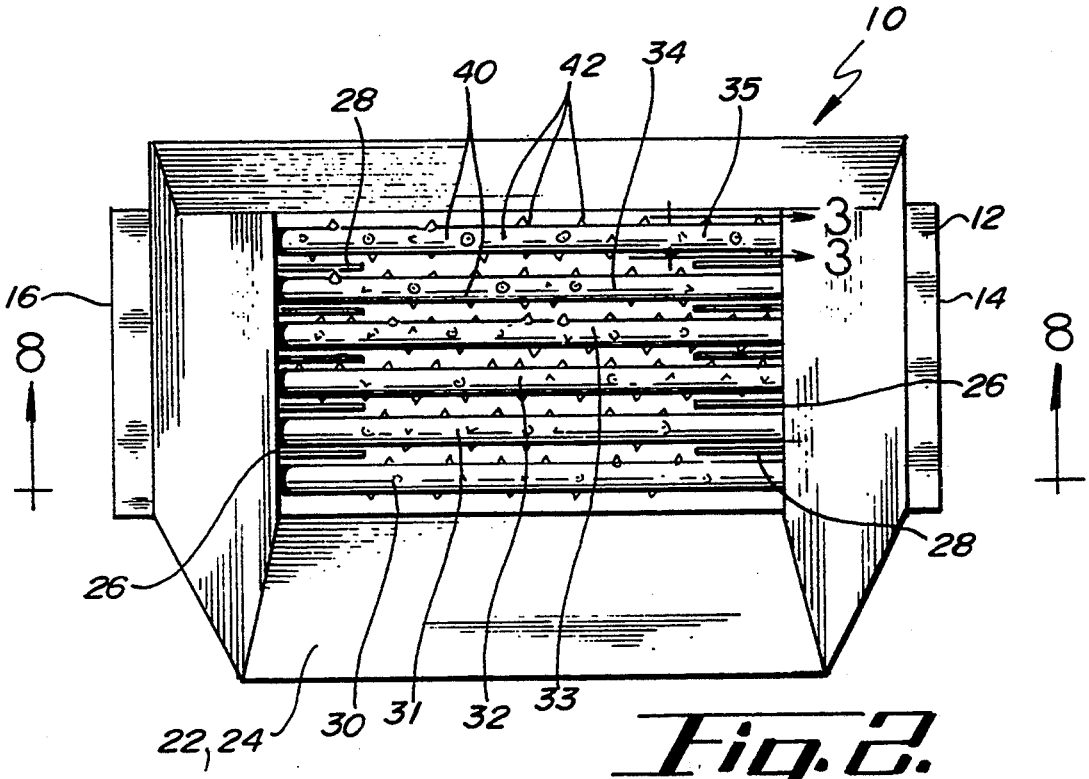
FIG. 2 is a top plan view of the apparatus.

Referring to FIGS. 1 and 2, the general nature of the material reduction apparatus 10 may be seen. The apparatus receives large pieces of material 5 which are reduced by the apparatus 10 into reduced material 8. The apparatus has a housing 12 with a left side 14 and right side 16. The housing 12 is supported by a frame 18 which elevates housing 12 off of either the floor or the ground to permit placement of a conveyor 20 therebelow for transporting the reduced material away. At the top of apparatus 10 is located the material loading bin 22 which comprises a wide mouth 24 formed from flanges 26. Extending downwardly and inwardly from flanges 26 are deflector bars 28 which keep the chunk material 5 within the central regions of the bin area 22 and to further prevent clogging of the apparatus 10.

Figure 3:
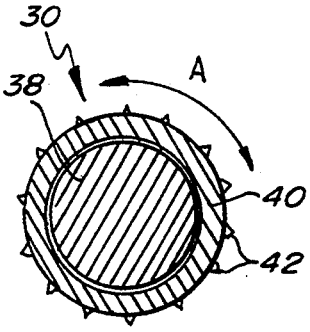
FIG. 3 is a cross-sectional view of one form of cutter bars taken along lines 3—3 of FIG. 2.
Figure 8:
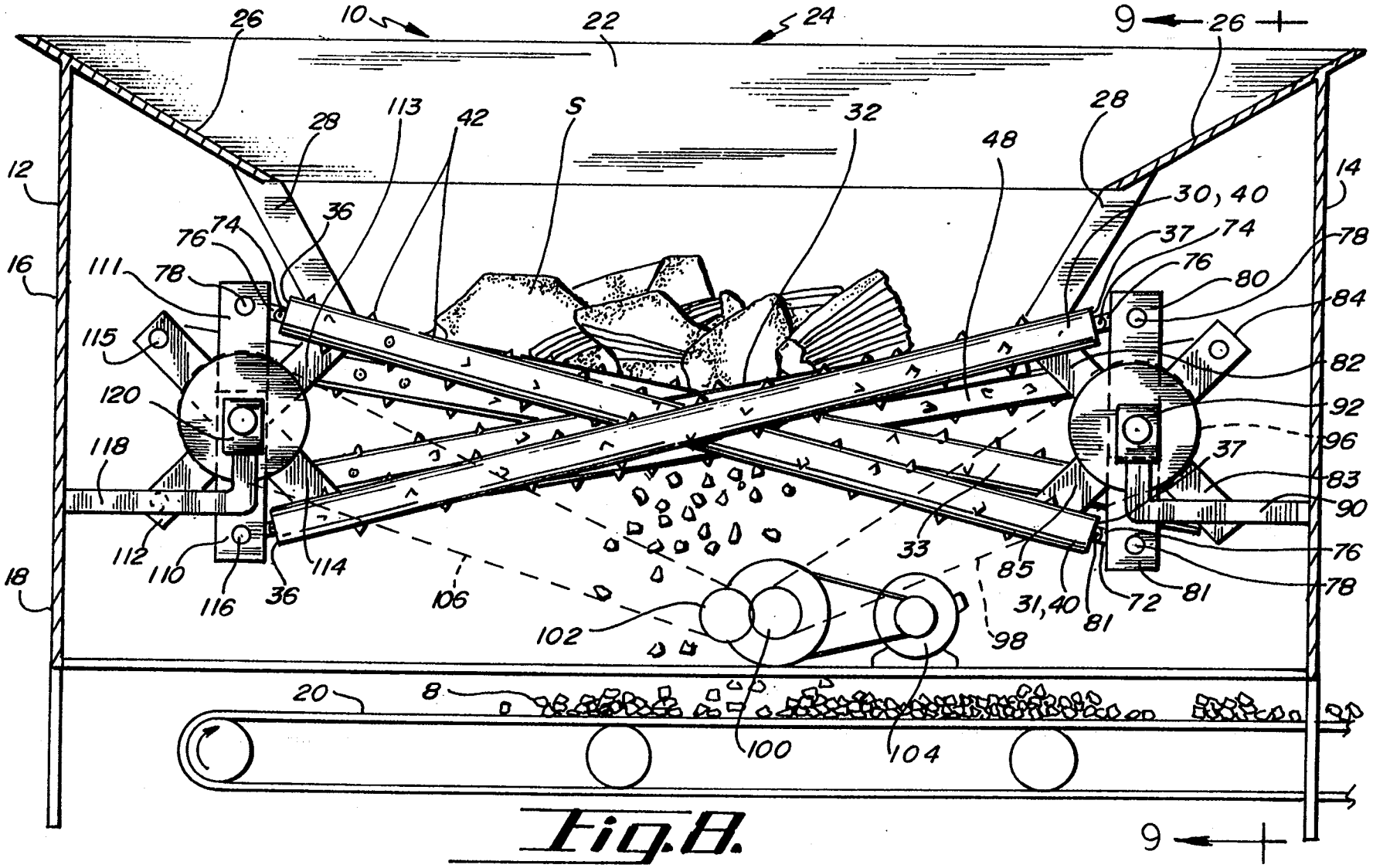
FIG. 8 is a cross-sectional view of the apparatus with material therein being reduced as taken along lines 8—8 of FIG. 2.
Figure 10:
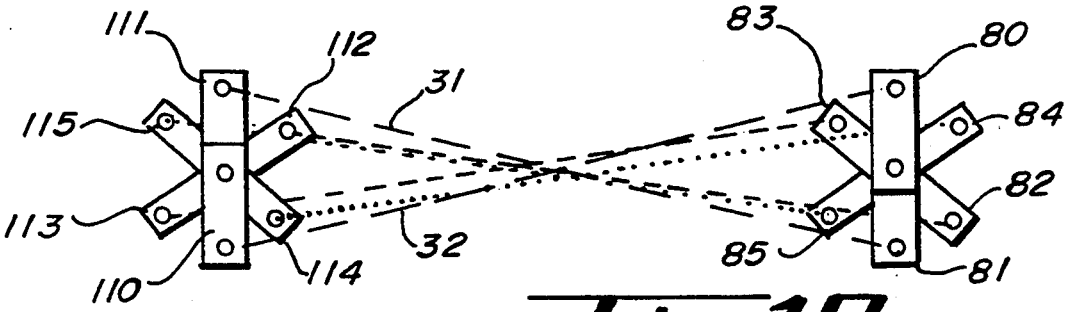
FIGS. 10 through 13 are schematic illustrations of the movement of the crank arms and cutter bars as they proceed through ¼ revolution of crank arm movement.
Figure 11:
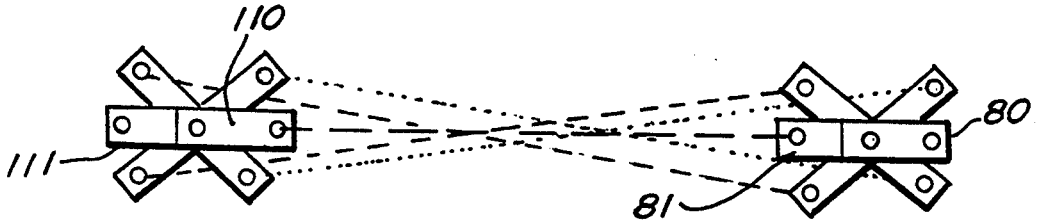
Figure 12:
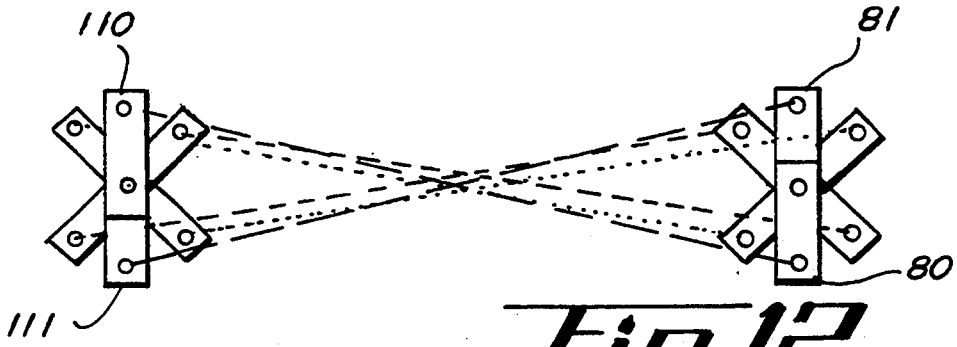
Figure 13:
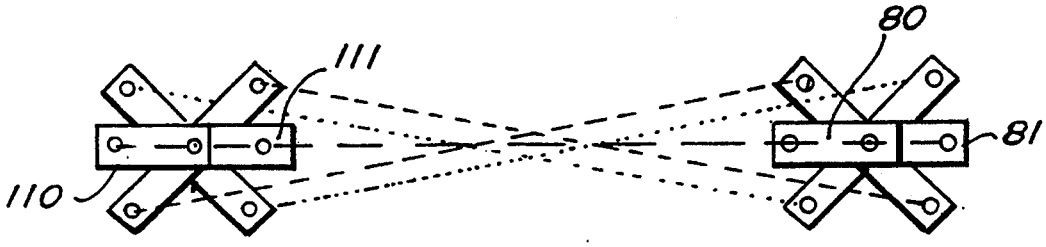

Again referring to FIGS. 2 through 7, the various types of appropriate cutters bars utilized in the apparatus 10 may be seen. Referring to FIGS. 2 and 3, it may be seen that cutter bars are arranged in pairs 30,31; 32,33; 34,35. Depending upon the size of the desired apparatus, there may be significantly more than or less than six cutter bars which are arranged in pairs of adjacent cutter bars. As seen in FIG. 8, each cutter bar has a right end 36 and a left end 37. The cutter bars of 32 as further shown in FIG. 3 are comprised of parallel rods or solid pipes 38 that are cylindrical in cross section. Rotatably mounted over rod 38 are tubes, pipes or cylinders 40 which support cutting tips 42 thereon. Arrow A shows that tube 40 may rotate about rod 38 to assist in the reduction of the material 5 and to further prevent clogging of the apparatus 10 by shingles, tar paper or the like.

Figure 5:
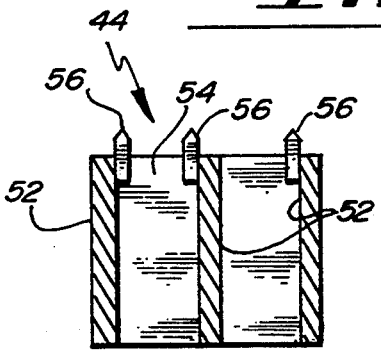
FIG. 5 is a cross-sectional view of the cutter bars of FIG. 4 taken along lines 5—5 of FIG. 4.
Figure 7:
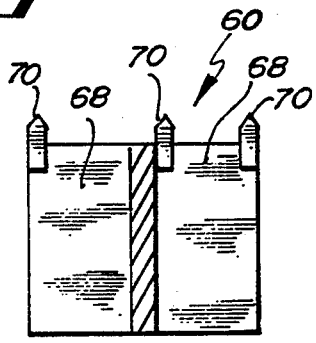
FIG. 7 is a cross-sectional view of the cutter bars of FIG. 6 taken along line 7—7.

As shown in FIGS. 4 and 5, the cutter bars may take the form of paired boxes 44,45; 46,47; 48,49. The boxes are each comprised of three substantially parallel sidewalls 52 with reinforcing dividers 54 therebetween. On the top of the sidewalls and perhaps adjacent to the dividers 54 are located upwardly directed cutting tips 56. Referring to the cutter bars of FIG. 6 and 7, the paired cutter bars 60,61; 62,63; 64,65, have laterally extending ears, wings or stubs 68 which support cutter tips 70.

Figure 9:
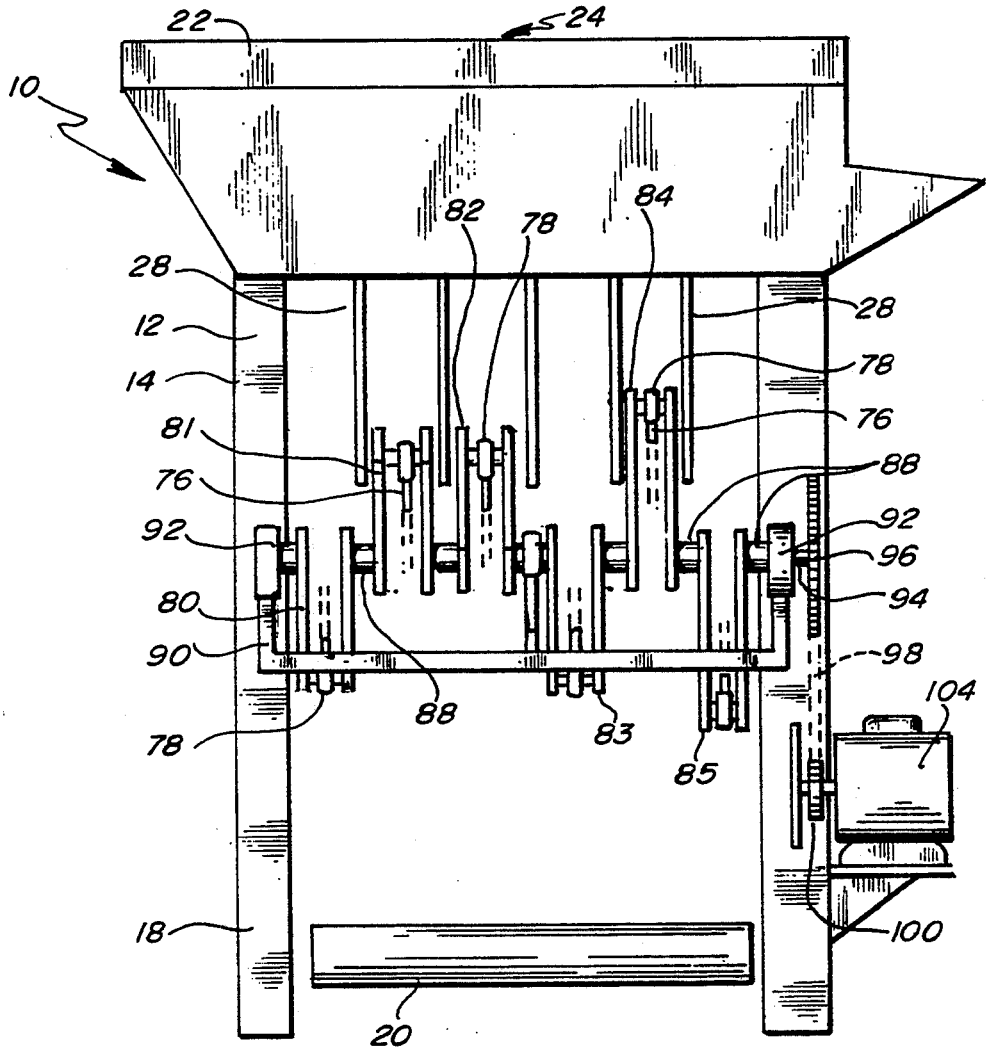
FIG. 9 is an end elevational view of the apparatus taken alone lines 9—9 of FIG. 8.

As seen in FIGS. 8 and 9, the ends 36 and 37 of the cutter bars 30,31; 32,33; 34,35 support mounting brackets or ears 72. Brackets 72 support pins and or bearings 74 which suitably and pivotally capture links 76. Links 76 then in turn by way of pins or bearings 78 are rotatably and pivotally captured by crank arms 80,81; 82,83; 84,85.

The first pair of crank arms 80,81 are 180° in respect to each other. The second pair of crank arms 82,83 are also 180° with respect to each other. The third pair of crank arms 84,85 are also 180° with respect to each other. The first pair of crank arms 80,81 are 120° with respect to second pair of crank arms 82,83. Also the second pair of crank arms 82,83 are 120° from the third pair of crank arms 84,85. Also the first pair of crank arms 80,81 are 120° in relation to the third pair of crank arms 84,85. The crank arms are interconnected by stub shafts 88 to keep all of the crank arms axially aligned and to permit their rotation without interference of cutter bars 30,31; 32,33; 34,35. The stub shafts 88 are supported by brackets 90 which further support bearings 92 for rotatable receipt of the stub shafts 88. A shaft 94 extends from the rearmost bearing 92 and is connected to a driven sprocket, tooth gear or pulley 96 which is driven by a chain or belt 98. The chain or belt 98 is then wrapped around a drive sprocket, tooth gear or pulley 100 which is meshed with a reverse gear 102, all of which are driven by a motor, chain and gear arrangement 104 as is commonly known. From reverse gear 102 is wrapped a chain or belt 106 which is also wrapped around another driven sprocket, tooth gear or pulley 108 for the crank arms 110,111; 112,113; 114,115 on the apparatus' right side 16.

The first pair of opposing crank arms 110,111 are also 180° apart with respect to each other and with respect to their opposing crank arms 80,81. The second pair of crank arms 112,113 are also 180° apart with respect to each other and with respect to their opposing crank arms 82,83. The third pair of crank arms 114,115 are also 180° apart with respect to each other and with respect to their opposing crank arms 84,85. Again, the first pair of crank arms 110,111 are 120° with respect to the second pair of crank arms 112,113. The second pair of crank arms 112,113 are 120° with respect to the third pair of crank arms 114,115. The first pair of crank arms 110,111 are also 120° with respect to the third pair of crank arms 114,115. The right side 16 crank arms 110,111; 112,113; 114,115 also have bearings and pins 116 similar to their opposing crank arms for pivotally interlocking with links 76 and the cutter bars 30,31; 32,33; 34,35. The right side crank arms are supported by brackets 118 which support bearings 124 receiving like stub shafts (not shown).

In operation, the motor chain and gear arrangement 104 together with the drive assembly rotate the right side 16 and left side 14 crank arms 110–115 and 80–85 in reverse rotation respectively. The result of this movement is the up and down, and left and right movement of the cutter bars quite unlike the adjacent cutter bars as to toss, kick and cut up the material 5 to be reduced.

FIGS. 10 through 13 illustratively show the ¼ rotational movement of all of the crank arms and cutter bars with respect to each other. These Figures clearly illustrate the bouncing, kicking and throwing motion of the cutter bars 30–35 created by the crank arms 80–85 (moving clockwise) and 110–115 (moving counterclockwise). Alternatively, the crank arms may move in opposite directions.

Figure 14:
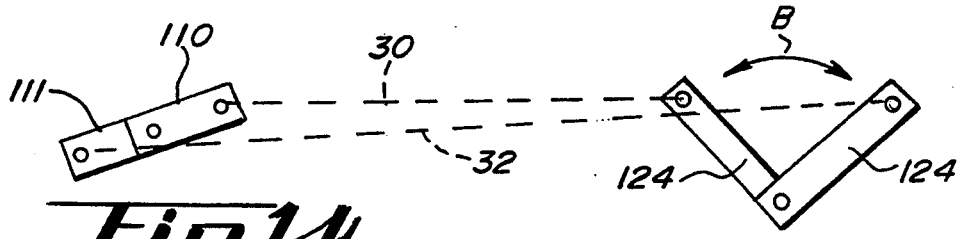
FIG. 14 is an illustration of another form of means for moving the cutter bars schematically illustrated.

FIG. 14 shows another embodiment wherein there is only one side of crank arms 110,111 which are connected to cutter bars 30 and 32. The other ends of cutter bars 30 adj 32 are connected to pivot arms or links 124 which create a to-and-fro or back-and-forth movement illustrated by Arrow B.

Figure 15:
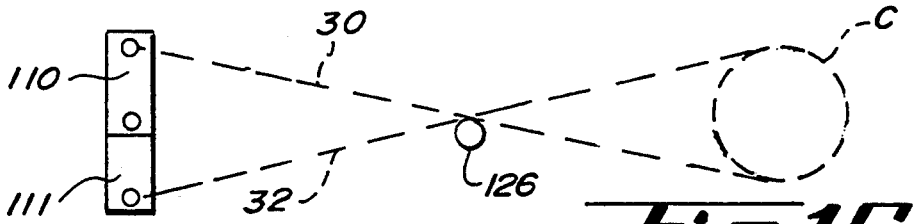
FIG. 15 is yet another form of means to move the cutter bars schematically shown.

FIG. 15 shows yet another embodiment wherein the cutter bars 30 and 32 have one pair of their ends connected to crank arms 110,111. Their opposite ends are free. The intermediate region of the cutter bars 30 and 32 are supported by a roller or bearing 126 therebelow to create circular movement of the opposite cutter bars ends illustrated by Circle C.

Figure 16:
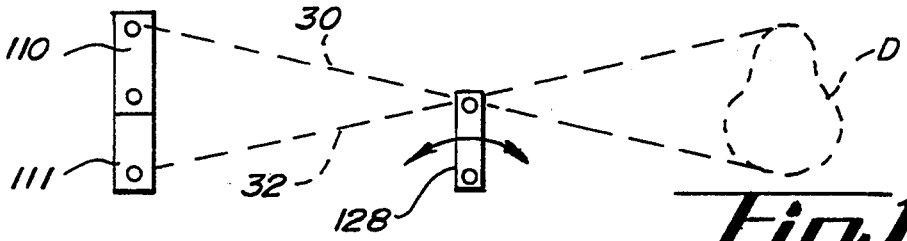
FIG. 16 is yet another form illustrating the means of moving the cutter bars schematically illustrated.

FIG. 16 shows another arrangement wherein the crank arms 110,111 are connected to one set of ends of the cutter bars 30 and 32 which are intermediately supported by a central pivot arm or link 128, thereby creating the pear-shaped movement D with respect to the opposite ends of cutter bars 30 and 32.

Figure 17:
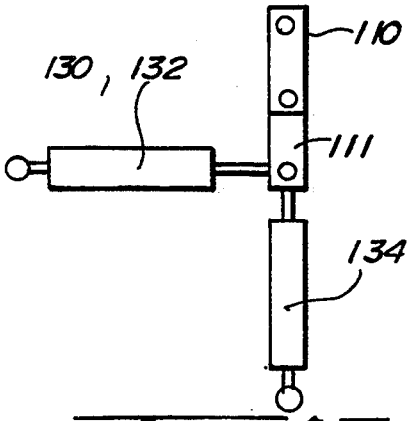
FIG. 17 showing the crank arms being hydraulically driven.

FIG. 17 shows another arrangement wherein the crank arms 110,111 are rotated by a hydraulic drive 130 comprised of cylinders 132 and 134.

Figure 18:
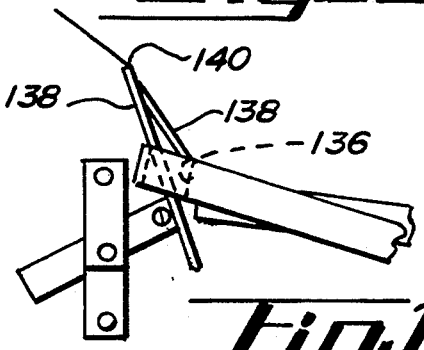
FIG. 18 is yet another embodiment wherein the cutter bars have dangle bars extending down through the ends of the cutter bars from the bin above for assisting in kicking the material about within the bin.

FIG. 18 shows another embodiment wherein the deflector bars 128 dangle or pivotally hang. That is, the cutter bars adjacent therein have slots 136 which slidably capture dangle bars 138 which are pivotally mounted to the mouth flange at 140 thereabove. By this arrangement, the dangle bars 130 also assist in kicking the material 5 within the bin 22.

Figure 19:
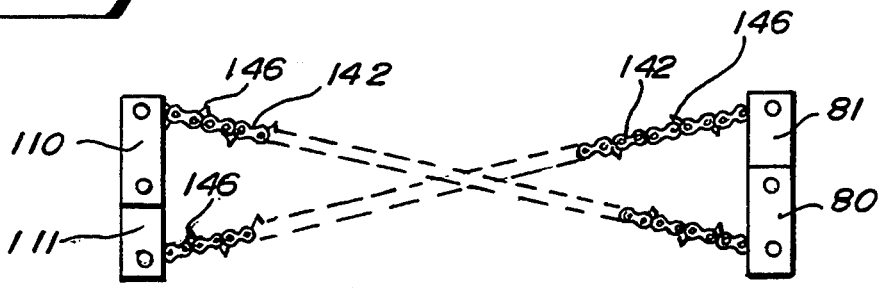
FIG. 19 is yet another embodiment of cutter bars wherein they are comprised of flexible chain segments with cutting tips thereon.

FIG. 19 also shows another embodiment wherein the cutter bars are flexible as in chains 142. Chains 142 then support cutter tips 146 for cutting the material 5.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

I claim:

1. A material reduction apparatus for reducing in size petroleum impregnated materials, wood materials and frangible materials for recycling, further processing and conservational disposal, comprising:

a) a material loading pin for receiving the material to be reduced;

b) a plurality of substantially parallel side by side cutter bars with upwardly directed cutting tips supported below the bin wherein the cutter bars each have opposing ends; and c) means connected to at least one end of each cutter bar for alternatingly moving each cutter bar upward and downward as well as parallel in line left to right unlike the movement of the adjacent cutter bar and wherein one end of each cutter bar moves in opposite direction as the other end of the same cutter bar to kick, toss and cut the material as to reduce the material from below.

2. The apparatus of claim 2 wherein the cutter bars are arranged in adjacent pairs and wherein the left and right ends of any cutter bars of any particular pair are 180° apart from the left and right ends of the other cutter bar of the same pair with respect to the moving means.

3. The apparatus of claim 2 wherein the ends of each pair of cutter bars are 120° apart from the ends of the adjacent pair of cutter bars with respect to the moving means.

4. The apparatus of claim 1 wherein the moving means are hydraulic drives.

5. The apparatus of claim 1 wherein the moving means comprise interconnected crank arms connected to ends of the cutter bars.

6. The apparatus of claim 5 wherein the crank arms are fixedly interconnected by stub shafts.

7. The apparatus of claim 5 wherein the cranks arms are arranged in adjacent pairs and the crank arms of each pairs are arranged 180° apart.

8. The apparatus of claim 7 wherein each pair of crank arms are arranged 120° from the crank arms of the adjacent pairs.

9. The apparatus of claim 1 wherein the cutter bars each have a longitudinal axis and a plurality of material cutter tips thereon, the cutter bars being adapted to rotatably turn about the axes.

10. The apparatus of claim 1 wherein the cutter bars each are comprised of a box structure with sidewalls, reinforcing dividers between the walls and upwardly projecting material cutter tips thereon.

11. The apparatus of claim 1 wherein the cutter bars each include laterally extending ear with upwardly projecting material cutter tips thereon.

12. The apparatus of claim 1 further comprising a conveyor below the cutter bars to carry away from the apparatus the reduced material.

13. A material reduction apparatus for reducing in size petroleum impregnated materials, wood materials and frangible materials for recycling, further processing and conservational disposal, comprising:

a) a material loading bin for receiving the material to be reduced;

b) a plurality of substantially parallel side by side cutter bars with upwardly directed cutting tips supported below the bin, the cutter bars each have opposing ends; and c) crank arms connected to the ends of each cutter bar to move each cutter bar upward and downward as well as parallel in line left to right movement unlike the movement of the adjacent cutter bar wherein the ends of each cutter bar move in opposite directions to kick, toss and cut the material as to reduce the material from below.

14. The apparatus of claim 13 wherein the cutter bars are arranged in adjacent pairs and wherein the left and right ends of any cutter bars of any particular pair are 180° apart from the left and right ends of the other cutter bar of the same pair with respect to the crank arms.

15. The apparatus of claim 14 wherein the ends of each pair of cutter bars are 120° apart from the ends of the adjacent pair of cutter bars with respect to the moving means.

16. The apparatus of claim 13 wherein the crank arms are fixedly interconnected by stub shafts.

17. The apparatus of claim 13 wherein the cranks arms are arranged in adjacent pairs and the crank arms of each pairs are arranged 180° apart.

18. The apparatus of claim 17 wherein each pair of crank arms are arranged 120° from the crank arms of the adjacent pairs.

19. The apparatus of claim 13 wherein the cutter bars each have a longitudinal axis and a plurality of material cutter tips thereon, the cutter bars being adapted to rotatably turn about the axes.

20. The apparatus of claim 13 wherein the cutter bars each are comprised of a box structure with sidewalls, reinforcing dividers between the walls and upwardly projecting material cutter tips thereon.

21. The apparatus of claim 13 wherein the cutter bars each include laterally extending ear with upwardly projecting material cutter tips thereon.

22. The apparatus of claim 13 further comprising a conveyor below the cutter bars to carry away from the apparatus the reduced material.

23. A material reduction apparatus for reducing in size petroleum impregnated materials, wood materials and frangible materials for recycling, further processing and conservational disposal, comprising:

a) a material loading bin for receiving the material to be reduced;

b) a plurality of substantially parallel cutter bars with opposing ends and upwardly directed cutting tips thereon supported below the bin, the cutter bar being arranged in adjacent pairs; and c) means pivotally connected to at least one end of each cutter bar for alternatingly moving each cutter bar upward and downward as well as parallel in line left to right unlike the movement of the adjacent cutter bar wherein the ends of each cutter bar move in opposite directions to kick, toss and cut the material as to reduce the material.

24. The apparatus of claim 23 wherein the left and right ends of any cutter bars of any particular pair are 180° apart from the left and right ends of the other cutter bar of the same pair with respect to the moving means.

25. The apparatus of claim 24 wherein the ends of each pair of cutter bars are 120° apart from the ends of the adjacent pair of cutter bars with respect to the moving means.

26. The apparatus of claim 23 wherein the moving means are hydraulic drives.

27. The apparatus of claim 23 wherein the moving means comprise interconnected crank arms connected to ends of the cutter bars.

28. The apparatus of claim 27 wherein the crank arms are fixedly interconnected by stub shafts.

29. The apparatus of claim 27 wherein the cranks arms are arranged in adjacent pairs and the crank arms of each pairs are arranged 180° apart.

30. The apparatus of claim 29 wherein each pair of crank arms are arranged 120° from the crank arms of the adjacent pairs.

31. The apparatus of claim 23 wherein the cutter bars each have a longitudinal axis and a plurality of material cutter tips thereon, the cutter bars being adapted to rotatably turn about the axes.

32. The apparatus of claim 23 wherein the cutter bars each are comprised of a box structure with sidewalls, reinforcing dividers between the walls and upwardly projecting material cutter tips thereon.

33. The apparatus of claim 23 wherein the cutter bars each include laterally extending ear with upwardly projecting material cutter tips thereon.

34. The apparatus of claim 23 further comprising a conveyor below the cutter bars to carry away from the apparatus the reduced material.

35. A material reduction apparatus for reducing in size petroleum impregnated materials, wood materials and frangible materials for recycling, further processing and conservational disposal, comprising:

a) a material loading bin for receiving the material to be reduced;

b) a plurality of substantially parallel cutter bars each with opposing ends and with upwardly directed cutting tips supported below the bin; and c) means connected to the cutter bar ends for alternatingly moving each cutter bar upward and downward as ell well parallel in line left to right unlike the movement of the adjacent cutter bar wherein the ends of each cutter bar move in opposite directions to kick, toss and cut the material as to reduce the material.

36. A material reduction apparatus for reducing in size petroleum impregnated materials, wood materials and frangible materials for recycling, further processing and conservational disposal, comprising:

a) a material loading bin for receiving the material to be reduced;

b) a plurality of substantially parallel cutter bars arranged in adjacent pairs, each bar with opposing ends and with upwardly directed cutting tips supported below the bin; and c) means connected to the cutter bar ends for alternatingly moving each cutter bar upward and downward as well as parallel in line left to right unlike the movement of the adjacent cutter bar and wherein the adjacent ends of any pair of cutter bars are substantially opposite with respect to the moving means to reduce the material.

* * * * *

UNITED STATES PATENT AND TRADEMARK OFFICE

CERTIFICATE OF CORRECTION

PATENT NO. : 5,340,038

DATED : August 23, 1994

INVENTOR(S) : Lawrence F. Omann

It is certified that error appears in the above-indentified patent and that said Letters Patent is hereby corrected as shown below:

In claim 35, Column 8, line 18, please delete the word "ell".
In clain 35, Column 8, line 18, after "well" insert --as--.

Signed and Sealed this

Thirteenth Day of June, 1995

*Attest:*

*Attesting Officer*

BRUCE LEHMAN

*Commissioner of Patents and Trademarks*